United States Patent [19]

Gross et al.

[11] 4,443,134

[45] Apr. 17, 1984

[54] YIELDABLE ROOF SUPPORT FOR MINE PASSAGES AND THE LIKE

[75] Inventors: Reinhold Gross, Heiligenhaus; Dietrich Willuhn, Troisdorf; Horst Witte, Mülheim, all of Fed. Rep. of Germany

[73] Assignee: Klöckner-Werke Aktiengesellschaft, Duisburg, Fed. Rep. of Germany

[21] Appl. No.: 274,714

[22] Filed: Jun. 17, 1981

[30] Foreign Application Priority Data

Jul. 16, 1980 [DE] Fed. Rep. of Germany ..... 3026837

[51] Int. Cl.[3] ..... E21D 15/44

[52] U.S. Cl. ..... 405/288; 405/290

[58] Field of Search ..... 405/282, 288, 289, 290, 405/291, 294, 132, 142, 146; 91/170 MP; 248/354 R, 354 H, 356

[56] References Cited

U.S. PATENT DOCUMENTS

| | | | |
|---|---|---|---|
| 3,800,549 | 4/1974 | Lobbe | 405/142 |
| 4,010,616 | 3/1977 | Lovat | 405/132 |
| 4,167,361 | 9/1979 | Petro et al. | 405/290 |
| 4,302,133 | 11/1981 | Althaler et al. | 405/290 |
| 4,307,981 | 12/1981 | Weirich et al. | 405/294 |

FOREIGN PATENT DOCUMENTS

| | | | |
|---|---|---|---|
| 1242562 | 8/1971 | United Kingdom | 405/288 |
| 635261 | 11/1978 | U.S.S.R. | 405/290 |

*Primary Examiner*—David H. Corbin

*Attorney, Agent, or Firm*—Watson, Cole, Grindle & Watson

[57] ABSTRACT

A yieldable roof support structure for mine passages and the like includes inner and outer hollow segments attached end-to-end to form a closed or an opened support frame, the segments including separating walls defining chambers associated with the joined together ends so that, upon application of pressure to the chambers, the joined segments are moved apart to facilitate a disassembly of the frame.

Alternatively, piston and cylinder units may span the joined ends of the segments for separating them upon the application of external pressure.

13 Claims, 10 Drawing Figures

YIELDABLE ROOF SUPPORT FOR MINE PASSAGES AND THE LIKE

RELATED APPLICATION

This application relates to U.S. Ser. No. 232,202 of Deitrich Willuhn, commonly owned herewith, and now abandoned.

BACKGROUND OF THE INVENTION

This invention relates to a yieldable closed or opened support frame for mine passages and the like, in the form of a plurality of adjoining inner and outer hollow segments frictionally joined together at opposite ends, and more particularly to means for moving the adjoining segments apart during a disassembly operation.

In such a yieldable roof support structure, for example, of the type set forth in the aforementioned related application, the entirety of which being specifically incorporated herein by reference, the overlapping ends of the adjoining inner and outer segments may become so tight when the frame is subjected to heavy overhead pressures in the mine passages or tunnel, that the segments are not capable of being easily disassembled for further reuse. Although the overlapping ends of the other segments are sufficiently elastic so as to permit distortion without permanent deformation during assembly with the inner segments, the extent of the overlap increases under the weight of the earth overhead during extended periods of use, such that movement of the joined segments apart may damage the segments thereby prohibiting their reuse.

SUMMARY OF THE INVENTION

It is therefore an object of the present invention to provide a yieldable support frame generally of the type set forth in the aforementioned related application, with means provided for releasing the joined segments for subsequent reuse without damaging or permanently distorting the segments.

Another object of this invention is to provide such a support frame wherein the ends of the segments are frictionally joined together in a fluid tight manner, and wall means in the segments define pressure chambers associated with the joined together ends so that upon application of fluid pressure to the chambers the outer segments form pressure cylinders and the inner segments form pistons within the cylinders for effecting movement of the segments away from one another.

A further object of the invention is to provide a yieldable support frame wherein the chambers are formed by fixed separating walls in the outer segments and at the terminal ends of the inner segments so that, upon application of pressure to the chambers, the inner segments are moved outwardly of the outer segments.

A still further object of this invention is to provide such a yieldable support frame wherein the pressure chambers are formed by movable transversely extending plates limited by spaced and perforated stop elements in the inner and/or outer segments for defining expandable pressure chambers to facilitate a gradual increase in chamber pressure during the segment releasing operation. The stop elements may be provided with packing seals facing the plates for rendering the pressure chambers fluid tight upon contact between the plates and the seals.

A still further object of this invention is to provide such a yieldable support frame wherein pressure applying means in the form of piston and cylinder units on the segments spanning each of the joined ends thereof are provided for moving the adjoining segments apart.

Further objects, advantages and novel features of the invention will become more apparent from the following detailed description of the invention when taken in conjunction with the accompanying drawings.

DETAILED DESCRIPTION OF THE INVENTION

Figure 1:
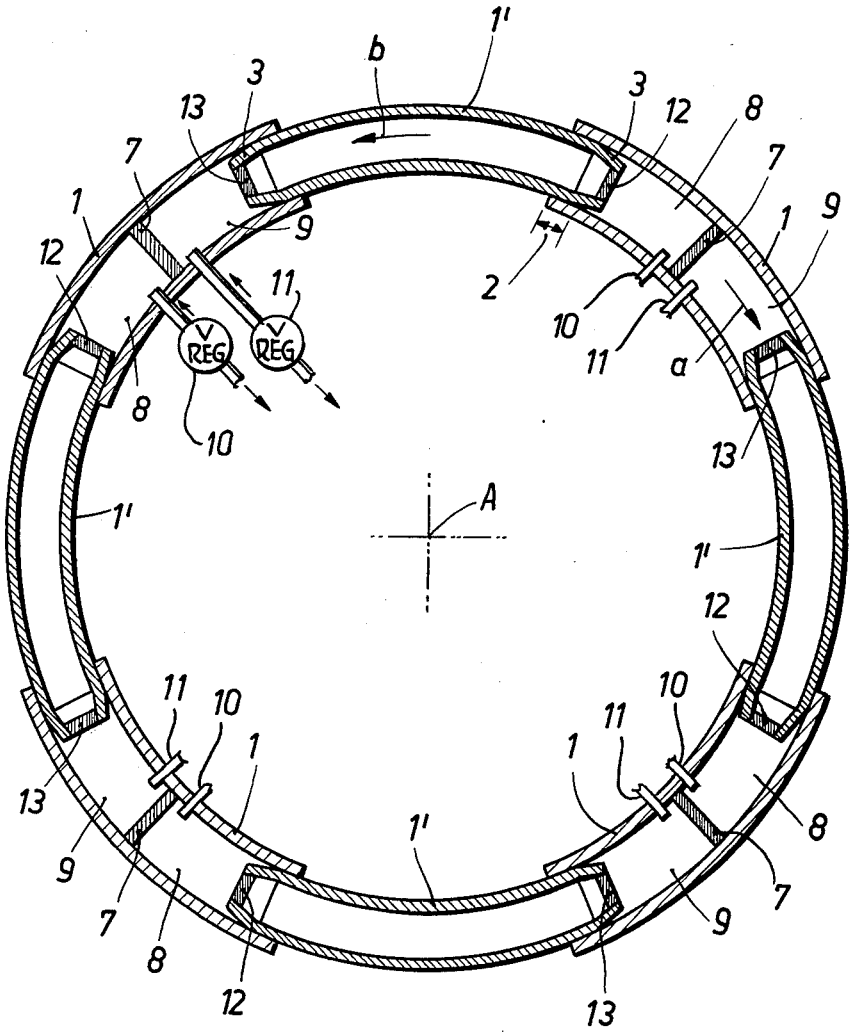
FIG. 1 is a vertical sectional view of a closed yieldable support frame according to the invention.

Turning now to the drawings wherein like reference characters refer to like and corresponding parts throughout the several views, a closed support frame is shown in vertical section in FIG. 1 as comprising arcuate outer and inner hollow segments 1 and 1' having a predetermined longitudinal extent (running along a central axis A of the frame), the segments being joined end-to-end with the outer segments separated by inner segments as shown. Opposite ends 3 of the inner segments extend partially into adjoining ends of the outer segments so as to form overlapping zones 2 at which the segments are frictionally joined together in a fluid-tight manner. As in the support frame described in the aforementioned related application, the ends of the inner segments may be slightly oversized relative to the inner dimensions of the outer segments to thereby effect a slight deformation of the outer segments which have elastic properties permitting distortion without permanent deformation. This slight deformation is confined to elastic zones at the overlapping ends of the outer segments. And, the ends of the outer segments may be tapered for insertion of the ends thereof into the hollow ends of the outer segments.

In accordance with the present invention, transversely extending separating walls or partitions 7 are fixedly and centrally mounted within outer segments 1, and the opposing terminal ends of inner segments 1' are capped by fixed walls 12 and 13. Such walls define chambers 8 and 9 which are respectively associated with the joined together ends. Fluid pressure is applied from a source (not shown) to the chambers via combined intake and outake regulating valves 10 and 11. These valves may extend from a common pressurized source, or valves 10 and 11 associated with the respective outer segments may be connected with separate pressurized sources of supply. In any event, upon the application of pressure to a chamber 8, for example, outer segment 1 will function as a pressure cylinder and the inwardly extending end of inner segment 1' will act as a piston moving outwardly of the cylinder in the direction of arrow b while the outer segment moves in the direction of the arrow a in response to increased pressure. One or more of the chambers 8 may be similarly pressurized for moving the adjoined inner and outer segments apart for disassembling the support frame. Thereafter, one or more chambers 9 may be similarly pressurized via valve or valves 11 for further separating the adjoined inner and outer segments at their opposite ends.

Figure 1A:
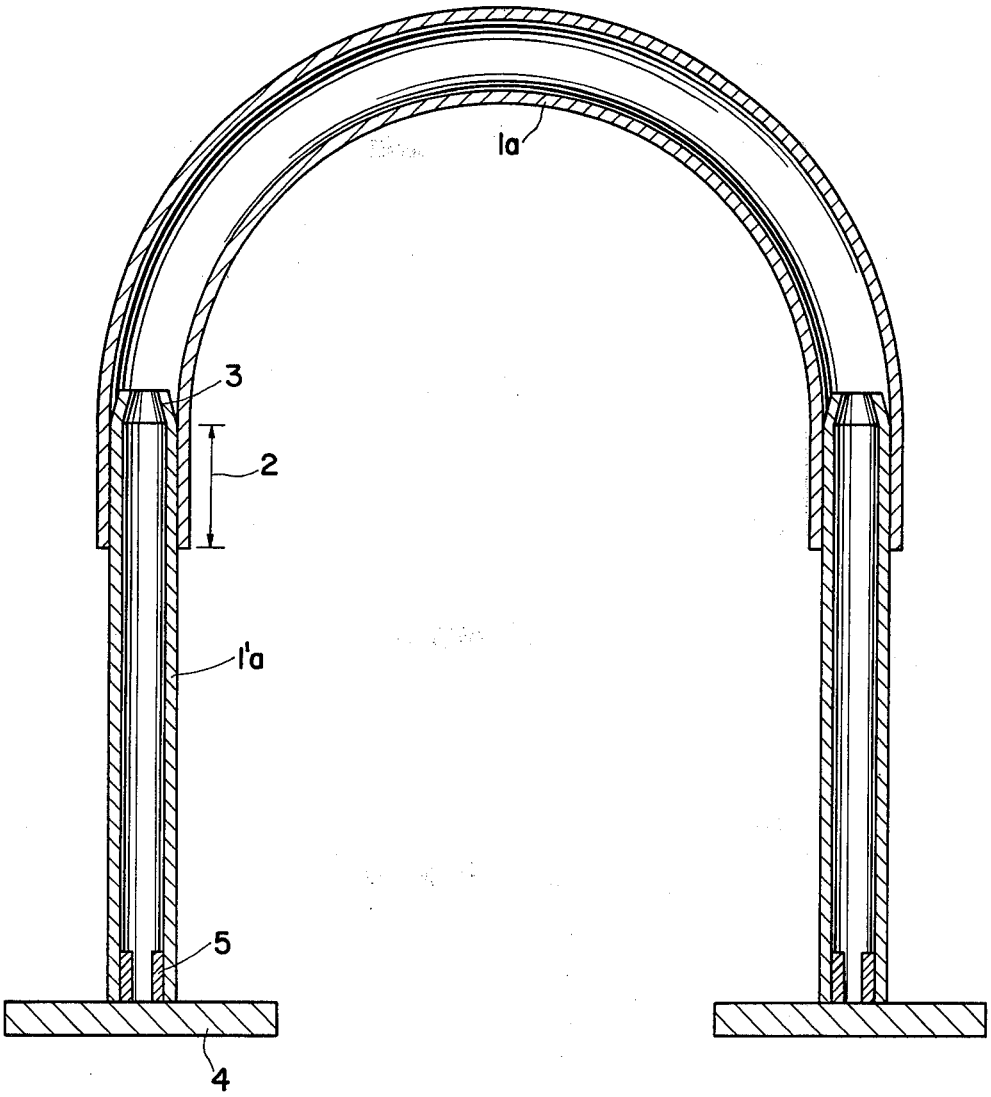
FIG. 1A is a vertical sectional view of an open yieldable support frame embodying the principles of the invention.

FIG. 1A illustrates an open yieldable support frame according to the invention using an arched, outer segment 1*a* and straight hollow inner segments 1'*a*. Flexing of the upstanding segments 1'*a* is substantially avoided by the provision of substantially rectilinear overlapping zones 2. And, inner segments 1'*a* are seated on anchor plates 4 which may have upstanding locators 5 extending to the free ends of the hollow inner segments.

The ends of segments 1*a* and 1'*a* are frictionally joined together in a fluid tight manner, and wall means, such as that shown in any of the FIGS. 1 to 4 embodiments, in the segments define pressure chambers associated with the joined together ends. Thus, upon application of pressure to the chambers, the outer segments forms a pressure cylinder and the inner segment forms a piston within the cylinder for effecting movement of the segments away from one another.

The wall means, chambers and pressure means are not illustrated in FIG. 1A for the sake of clarity and since they are detailed in FIGS. 1 to 4.

Figure 2:
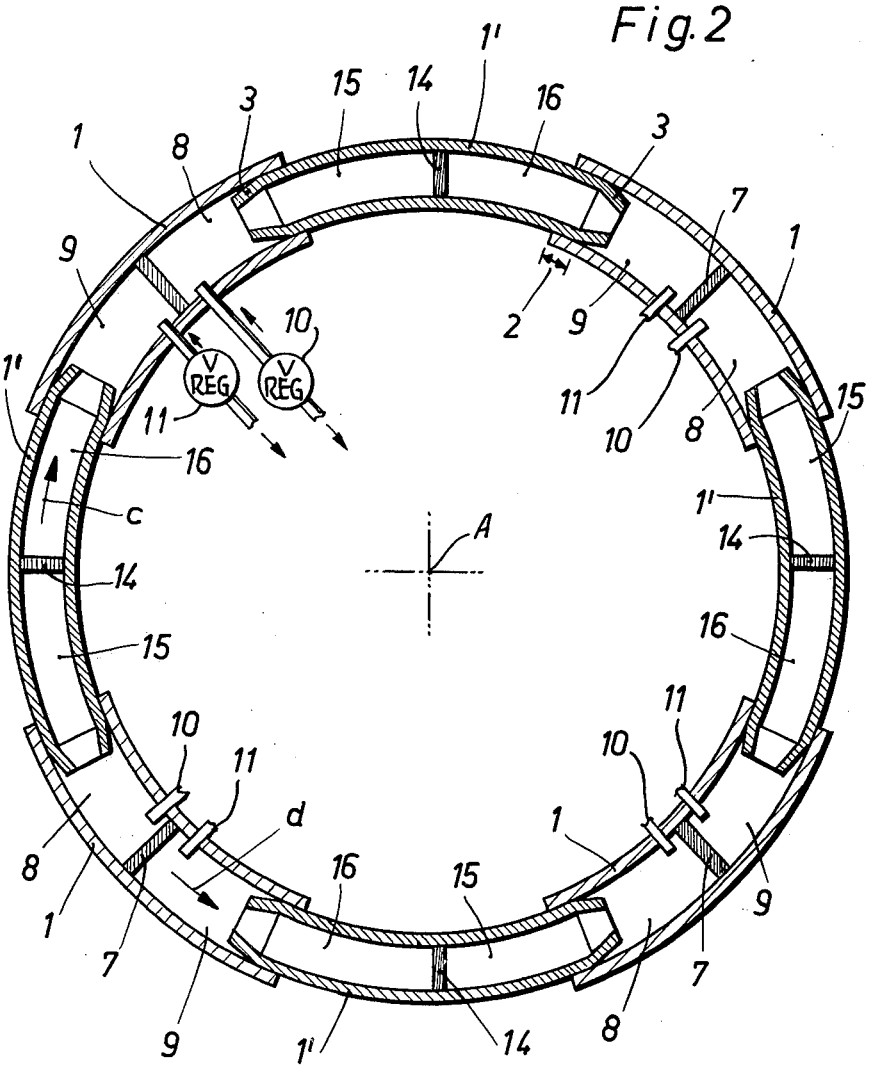
FIG. 2 is a view similar to FIG. 1 of another embodiment according to the invention.

Another embodiment of a closed support frame according to the invention is shown in FIG. 2 which is similarly constructed as the FIG. 1 frame with like parts being identified by the same reference numerals. However, inner segments 1' of FIG. 2 are not end capped as at 12 and 13 but are instead provided with fixed and centrally located separating walls or partitions 14 defining chambers 15 and 16 on opposite sides which respectively communicate with chambers 8 and 9. Thus, the same principles apply as described with reference to FIG. 1 in that, upon application of pressure to chamber 8, 15 through one of the valves 10, for example, until the pressure overcomes the frictional force holding the overlapping ends together, the inner and outer segments will move away from one another respectively in the direction of their arrows c and d.

Figure 3:
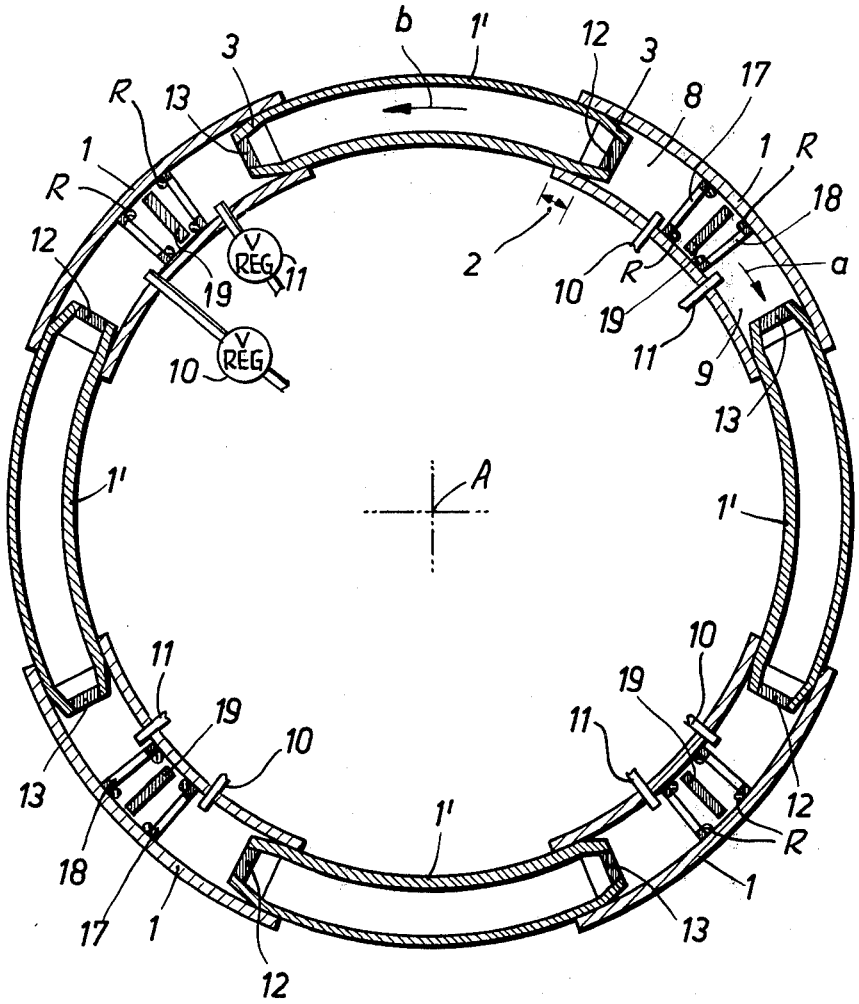
FIG. 3 is a view similar to FIG. 1 of still another embodiment according to the invention.

A further embodiment of the present invention is shown in FIG. 3 which is a variant of the FIG. 1 support frame so that, again, like parts are identified by the same reference numerals. As in FIG. 1, inner segments 1' are capped at opposite ends as at 12 and 13, although the outer segments are provided with transverse plates 19 extending longitudinally in the direction of central axis A and are shiftable within the outer segments between a pair of spaced stop elements 17 and 18 which are fixed in place and have central openings. Packing seals in the form of annular rings R are provided on the inner sides of the stop elements facing plates 19. Means (not shown) may be provided along the inner surfaces of outer segments 1, between stop elements 17 and 18, for guiding plates 19 during their shifting movements. Thus, upon application of pressure to chamber 8, for example, the chamber will expand as plate 19 moves against packing ring R of stop element 17. Upon increase of pressure sufficient to overcome the frictional force holding the overlapping ends of the adjoined segments together, the inner and outer segments will be moved away from one another respectively in the directions of their arrows b and a.

Figure 4:
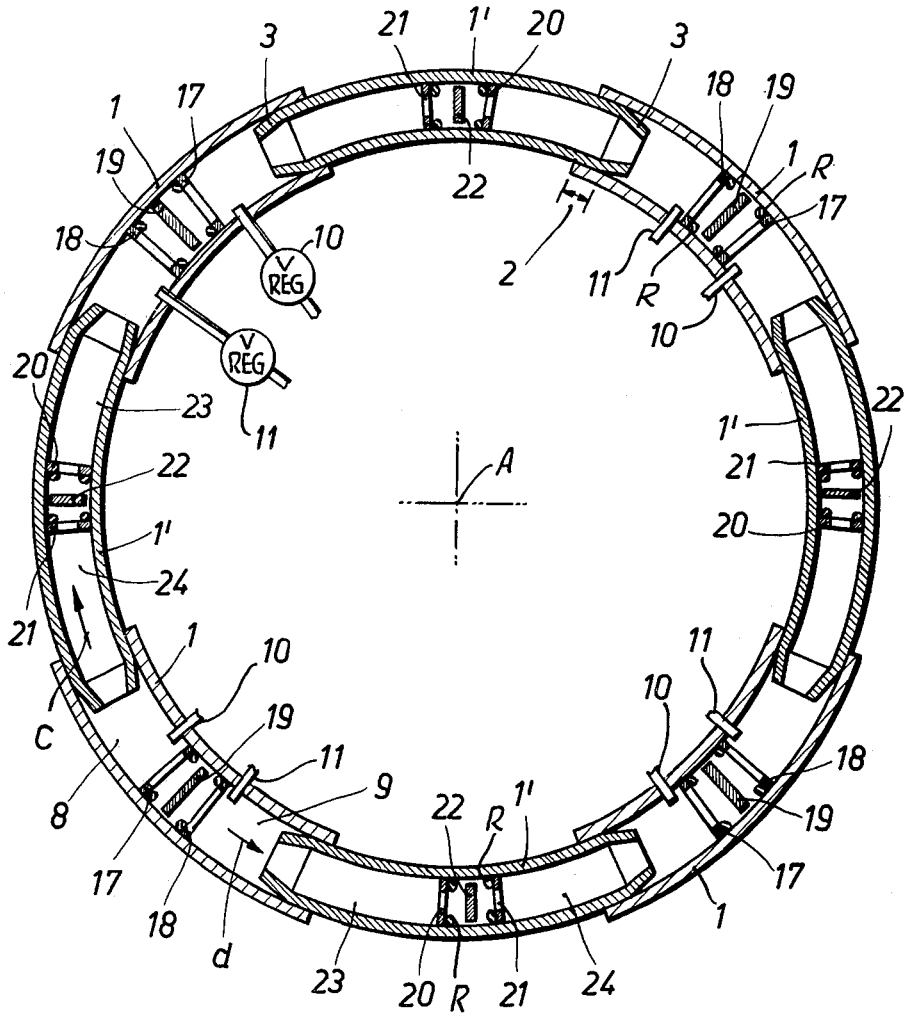
FIG. 4 is a view similar to FIG. 1 of a still further embodiment according to the invention.

FIG. 4 is a still further embodiment of the invention, and is a variant of FIG. 3 with like parts being identified by same reference numerals. Here, end caps 12 and 13 of the inner segments are eliminated, and floating separating walls 22 are provided in the inner segments between pairs of spaced stop elements 20 and 21. These stop elements are similar to stops 17 and 18 in that they are likewise fixed in place and have central openings with packing seals in the form of annular rings R surrounding such openings. Chambers 23 and 24 are defined in the inner segments on opposite sides of plates 22 and respectively communicate with chambers 9 and 8. Thus, upon the application of pressure to chamber 8, 24, for example, plates 19 and 22 will be shifted until they respectively bear against the packing rings of stop elements 18 and 20 where upon this chamber expands until the pressure therein overcomes the frictional force holding the overlapping ends of the segment together. At such time, the inner and outer segments will be moved away from one another in the direction of their respective arrows c and d.

The chambers as aforedescribed may be pressurized by air or by hydraulic liquid. For the latter, a removable oil collector or cuff (not shown) may be provided at the junction between overlapping ends of the segments for collecting the oil so that it may be fed back into the oil reservoir of the pump (not shown).

Figure 5:
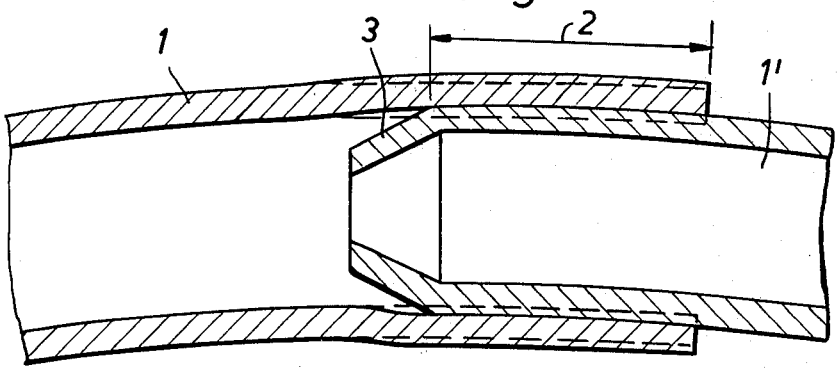
FIGS. 5 and 6 are enlarged sectional views of the overlapping ends of the joined segments showing two exemplary embodiments.

FIG. 5 is a typical sectional view of the overlapping ends of the inner and outer segments, a typical free end of outer segment being shown in dashed outline before insertion of inner segment 1' and being shown in solid outline upon deformation after insertion of the inner segment to form overlapping zone 2. For clarity of illustration, the wall thickness of the outer segment is shown grossly exaggerated, and the degree of deformation of the outer section is also shown exaggerated. In overlapping zone 2 the contacting surfaces of the inner and outer segments are complementary, the inner segments being slightly oversized to effect a tight frictional fit with slight deformation of the outer segment. Tapered ends 3 of the inner segments permit them to be easily plugged into the hollow ends of the outer segments, during assembly.

Figure 6:
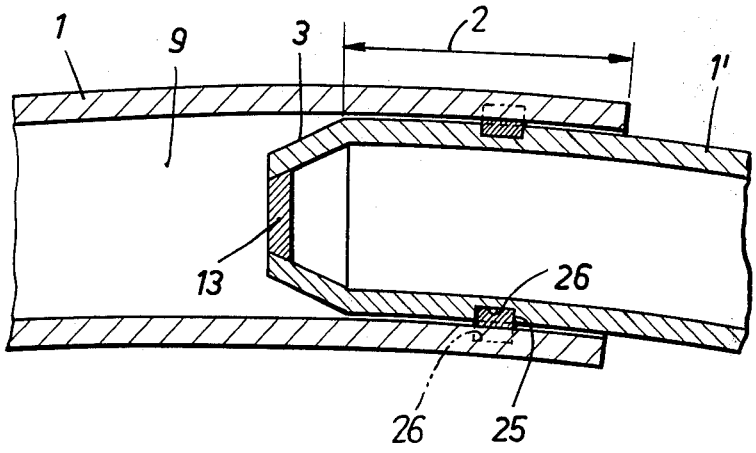

The frictional fit between overlapping ends of the outer and inner segments may instead be accomplished, as in FIG. 6, by the provision of a packing seal in the form of an annular ring 25 disposed between the segments. Such a ring seal, which effects a fluid tight connection, may be of Teflon, a registered trademark of the DuPont Company. The seal ring may extend outwardly of an annular groove 26 provided in the outer surface of the inner segment 1', or may extend outwardly of an annular groove 26' provided in the inner surface of outer segment 1. In both cases, an opposing surface of the seal ring bears against an adjacent surface of one of the segments. Chamber 9 may be pressurized with a fluid for preventing inner segments 1' from extending into outer segment 1 beyond an undesirable amount. Chamber 9 may thus be vented by the provision of an excess pressure valve (not shown). And, the chambers of the outer segments may be attached at all times to a pressure pump for carrying out the invention.

Figure 7:
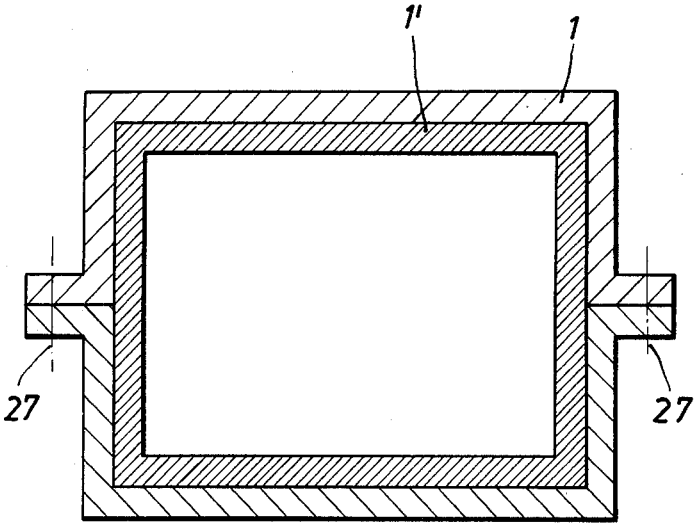
FIG. 7 is a cross-sectional view taken through a typical overlap between adjoining ends of inner and outer segments according to the invention.

The outer segments may be formed of an identical pair of half sections shown in FIG. 7 having outwardly extending mating flanges with aligned openings along lines 27 for the reception of threaded fasteners or the like. And, the inner segments may be formed of closed rectilinear sections.

After one or more of the adjoining outer and inner segments are moved apart from one another as aforedescribed, they may be further disassembled by removing the innermost section of segment 1 whereafter a segment 1' may be removed.

Figure 8:
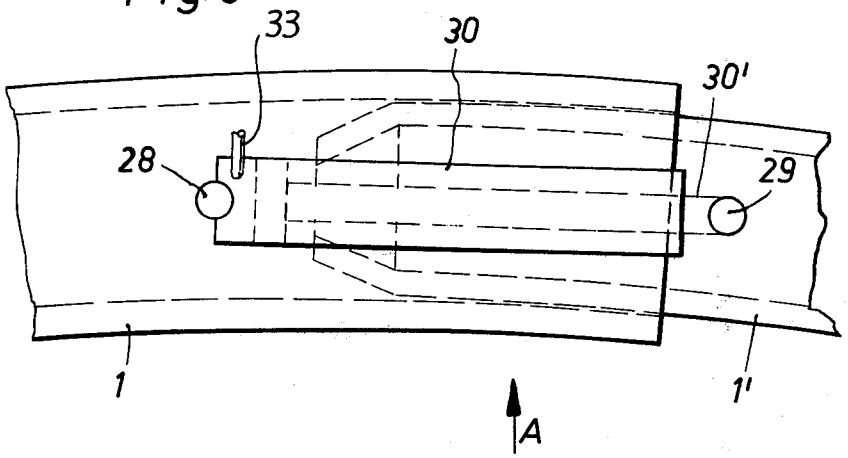
FIGS. 8 and 9 are respectively side and top views of an alternative means according to the invention for releasing the inner and outer segments at their joined ends.
Figure 9:
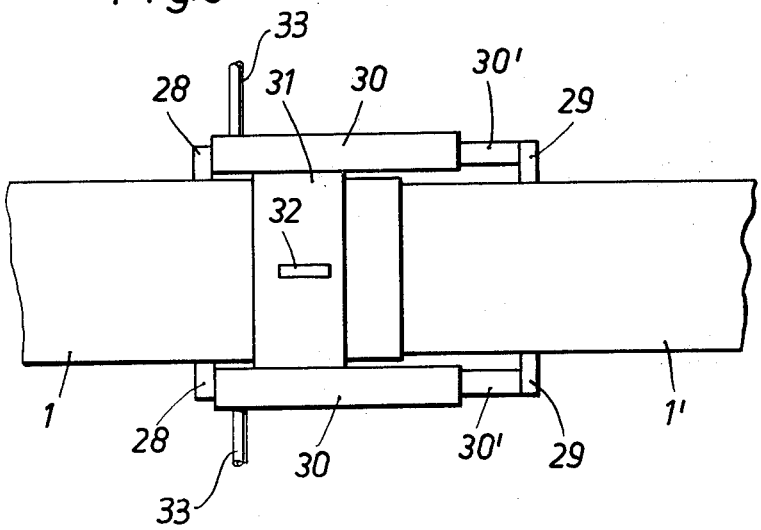

Another embodiment of the invention is shown in FIGS. 8 and 9 as comprising an externally applied pressure actuator for separating the overlapping ends of the segments. A pair of piston and cylinder units are mounted on opposite sides of the inner and outer segments, each such units comprising a pressure cylinder 30 mounted on segment 1 as at 28 and a piston 30' mounted on segment 1' as at 29. The pair of cylinders are interconnected together by a support plate 31 to facilitate installation on mountings 28 and 29, and a handle 32 may be provided on the support plate to facilitate easy handling. Pressure lines 33 provided for cylinders 30 may be connected to a common pressure source for extending pistons 30' together for moving the adjoining segments apart.

Obviously, many other modifications of the present invention are made possible in light of the above teachings. It is therefore to be understood that within the scope of the appended claims the invention may be practiced otherwise than as specifically described.

What is claimed is:

1. A yieldable roof support structure for mine passages, tunnel extensions, and the like, comprising an arch structure formed of at least one longitudinally extending outer segment and at least one longitudinally extending inner segment each of hollow construction having enclosed sides and being frictionally joined together in a fluid tight manner in telescoping end-to-end relationship to form an arched support frame, an end of said inner segment being oversized relative to an end of said outer segment and extending into same, said outer segment being of elastic material permitting distortion thereof at said joined ends without permanent deformation to thereby define a yieldable roof support, means for solely facilitating disassembly of said segments during non-use, said means comprising transversely extending separating walls in said segments defining at least one pressure chamber in which said outer segment forms a pressure cylinder and said inner segment forms a piston at said joined ends, means for applying fluid pressure to said chamber for moving said segments apart during the disassembly thereof, and said outer segment comprising a pair of longitudinally extending mating sections releasably secured together to further facilitate disassembly of said segments during non-use.

2. The structure according to claim 1, wherein said separating walls are mounted at a terminal end of said inner segment and between opposite ends of said outer segment.

3. The structure according to claim 1, wherein said separating walls are mounted between opposite ends of said inner segment and between opposite ends of said outer segment.

4. The structure according to claim 1, wherein said fluid pressure applying means includes a combined inlet and outlet pressure valve.

5. The structure according to claim 2, wherein one of said separating walls between said opposite ends of said outer segment comprises a movable plate, a pair of spaced, perforate stop elements being provided in said outer segment respectively on opposite sides of said plate, whereby said pressure chamber is expandable upon the application of said fluid pressure applying means which shifts said plate against one of said stop elements.

6. The structure according to claim 3, wherein said separating walls comprise movable plates, and spaced, perforate stop elements being provided in said segments respectively on opposite sides of said plates, whereby said pressure chamber is expandable upon the application of said fluid pressure applying means which shifts said plates against outer ones of said stop elements.

7. The structure according to claim 5, wherein said fluid pressure applying means includes a combined inlet and outlet pressure valve.

8. The structure according to claim 6, wherein said fluid pressure applying means includes a combined inlet and outlet pressure valve.

9. The structure according to claim 5, wherein packing seals are provided on said stop elements facing said plate for forming a fluid tight seal upon the shifting of said plate thereagainst.

10. The structure according to claim 6, wherein packing seals are provided on said stop elements facing said plates for forming fluid tight seals upon the shifting of said plates thereagainst.

11. A yieldable roof support structure for mine passages, tunnel extensions, and the like, comprising an arch structure formed of at least one longitudinally extending outer segment and at least one longitudinally extending inner segment each of hollow construction having enclosed sides and being frictionally joined together in a fluid tight manner in telescoping end-to-end relationship to form an arched support frame, an end of said inner segment being oversized relative to an end of said outer segment and extending into same, said outer segment being of elastic material permitting distortion thereof at said joined ends without permanent deformation to thereby define a yieldable roof support, means for solely facilitating disassembly of said segments during non-use, said means comprising pressure applying means mounted on the exterior of said segments and spanning said joined ends for moving said segments apart during the disassembly thereof.

12. The structure according to claim 11, wherein said pressure applying means comprise pressurized units on opposite sides of said segments and each including a piston and cylinder respectively mounted on said inner and outer segments.

13. The structure according to claim 12, wherein said cylinders are interconnected to one another and to a common pressure source.

* * * * *